US005361706A

United States Patent [19]

Kunczynski

[11] Patent Number: 5,361,706

[45] Date of Patent: Nov. 8, 1994

[54] CONVEYING SYSTEM WITH TENSIONING AND DOCKING ASSEMBLY AND METHOD

[75] Inventor: Jan K. Kunczynski, Glenbrook, Nev.

[73] Assignee: Yantrak, LLC, Carson City, Nev.

[21] Appl. No.: 69,082

[22] Filed: May 28, 1993

[51] Int. Cl.[5] ..... B61B 7/00

[52] U.S. Cl. ..... 104/196; 104/173.1; 188/312; 198/750

[58] Field of Search ..... 104/173.1, 193, 196; 188/312; 198/750

[56] References Cited

U.S. PATENT DOCUMENTS

| | | | |
|---|---|---|---|
| 1,273,053 | 7/1918 | Hild | 188/312 |
| 3,113,767 | 12/1963 | Halberstadt | 198/750 X |
| 3,437,315 | 4/1969 | McDonald, Jr. | 104/196 X |
| 3,875,868 | 4/1975 | Martin, Jr. | 104/173.1 X |
| 4,308,945 | 1/1982 | Beckmann et al. | 104/173.1 X |

FOREIGN PATENT DOCUMENTS

| | | | |
|---|---|---|---|
| 1431664 | 2/1966 | France | 104/173.1 |
| 629712 | 5/1989 | Switzerland | 104/196 |
| 614007 | 7/1978 | U.S.S.R. | 104/193 |
| 1733308 | 5/1992 | U.S.S.R. | 104/173.1 |

*Primary Examiner*—Matthew C. Graham
*Assistant Examiner*—S. Joseph Morano
*Attorney, Agent, or Firm*—Flehr, Hohbach, Test, Albritton & Herbert

[57] ABSTRACT

A conveying or transportation system having a haul rope (22) mounted for movement along a path, a terminal (31) positioned along the path and having a docking surface (52), and a carrier unit (27) coupled to the haul rope (22). The carrier unit (27) is coupled to the haul rope (22) by a rope coupling assembly (51), preferably in the form of a hydraulic piston-cylinder assembly (53) and fluid circuit (54), formed to create and maintain tension in the haul rope (22) during transport of the carrier unit (27) and formed for yieldable displacement of the haul rope (22) relative to the carrier unit (27) upon engagement of the carrier unit (27) with the docking surface (52) at the terminal (31). The fluid piston-cylinder assembly (53) preferably includes two pistons (57, 58) which are movably mounted in a common cylinder (56) and connected to a fluid circuit (54) which allows fluid to flow from opposed sides (68, 71) of the respective pistons (57, 58) for floating of the pistons (57, 58) inside the cylinder (56) upon docking and over-driving of the haul rope (22). A method of tensioning the haul rope (22) and of docking a haul rope-driven carrier unit (27) by advancing it up to and over-driving the haul rope (22) beyond engagement of the carrier unit (27) with a docking surface (52) also is provided.

21 Claims, 5 Drawing Sheets

CONVEYING SYSTEM WITH TENSIONING AND DOCKING ASSEMBLY AND METHOD

TECHNICAL FIELD

The present invention relates, in general, to transportation or conveying systems, such as aerial tramways, which are driven by a haul rope, and more particularly, relates to shuttle-type conveying systems in which docking of the passenger carrier unit with a terminal must be precisely accomplished.

BACKGROUND ART

Shuttle-type transportation or conveying systems have been employed in which two passenger or load carrier units are coupled in a loop-type haul rope and driven back and forth between terminals, usually located proximate the ends of the haul rope loop. Such systems may or may not include intermediate terminals, and the passenger carrier units may be supported by wheels on a support surface or track, or suspended from the haul rope by means of support sheaves over part or all of the path.

A constant problem in such shuttle tramway systems is maintaining uniform, and preferably symmetrical tensioning forces in the haul rope. This is usually accomplished at the haul rope drive or bull wheels or through a counterweight assembly acting on the haul rope. Counterweight systems result in rope tension forces which are not always symmetrical in terms of the direction of driving of the haul rope, and bull wheel tensioning systems require complex carriage mounting assemblies.

Another difficult problem in connection with shuttle tramway systems is the problem of accurate docking at the terminals. Federal handicap access regulations require, for example, that there be no more than a one inch gap between the passenger carrier unit and the terminal at the ingress and egress doors.

In haul rope-driven conveying systems, the bull wheel which drives the haul rope can only be slowed and stopped with a certain degree of precision. It is desirable to accelerate the carrier units from zero to their maximum velocity and then decelerate them back down to zero at rates which are comfortable to passengers. The mass of the carrier units and their load will, however, cause elastic stretching and even oscillation of the haul rope during the docking process, and can produce slippage of the haul rope with respect to the driving bull wheel. Thus, over time, the combination of bull wheel imprecision, haul rope elasticity and carrier unit mass will create unacceptable docking imprecision, which in turn requires system adjustments. The problem is further complicated when two passenger carrier units are driven by a single haul rope in a shuttle system at which the passenger carrier units must dock simultaneously at opposed end terminals.

In various urban environments, for example, at airports, considerable use of shuttle conveying systems has been made. Most of these systems, however, tend to be based upon a single car or passenger carrier unit that is rail-mounted driven by a motor carried by the car or by driven tires adjacent to the car along the path to be travelled. Very little has been done with haul rope-driven passenger conveying systems in urban applications.

Accordingly, it is an object of the present invention to provide a tensioning apparatus and method for a haul rope-driven transportation system which allows symmetrical rope tension to be achieved regardless of the direction of haul rope advancement.

It is another object of the present invention to provide a haul rope-driven, load carrying, conveying or transportation system having a docking assembly which is capable of precise, repeated docking of the load carrying units or vehicles at terminals.

Another object of the present invention is to provide a load carrying conveying system and method in which the load carrying units can be displaced on the driving haul rope to ensure proper docking of the units at terminals for loading and unloading of passengers and other loads.

Still another object of the present invention is to provide a haul rope-driven passenger conveying system suitable for use in urban environments and having improved tensioning and docking capability.

Still a further object of the present invention is to provide a shuttle-type passenger conveying system which is durable, has a minimum number of components, can be easily repaired and maintained, and does not require an on-board operator.

The conveying system of the present invention and method have other features and advantages which will become apparent from and are set forth in more detail in the following description of the Best Mode Of Carrying Out The Invention.

DISCLOSURE OF INVENTION

In one aspect, the conveying or transportation system of the present invention comprises, briefly, a loop-type haul rope mounted for movement to a plurality of support sheaves, a load carrying unit, a haul rope tensioning assembly carried by said load carrying unit and formed to tension said haul rope, and an assembly coupling said load carrying unit to said haul rope.

In another aspect, the load carrying conveying system of the present invention is comprised, briefly, of a haul rope mounted for movement along a path, a terminal positioned along the path and having a docking surface, and a carrier unit coupled to the haul rope to be conveyed along the path to the terminal by a rope coupling assembly formed to maintain tension in the haul rope during conveying and formed for yieldable displacement of the carrier unit relative to the haul rope upon engagement of the carrier unit with the docking surface at the terminal. Preferably the rope coupling assembly is provided by a hydraulic piston-cylinder assembly in which two pistons are mounted in a common cylinder and the cylinder is attached to the carrier unit. The pistons are coupled to opposite ends of the haul rope, and a fluid circuit connects between the working volumes of the cylinder so as to allow fluid to move from one working volume to the other in order to maintain tension in the haul rope and allow advancement of the haul rope while the load carrying unit is engaged with the terminal docking surface.

The method of tensioning a haul rope in a haul rope-driven conveying assembly is comprised of the step of mounting a haul rope tensioning assembly to a load carrying unit coupled to the haul rope.

The method of precisely docking a load carrier unit at a terminal in a conveying system is comprised of the steps of advancing a haul rope coupled to the load carrier unit by a rope coupling assembly until the load carrier unit is proximate a docking surface at the terminal, and thereafter continue to advance the haul rope over a distance sufficient to ensure to engagement of the load carrying unit with the docking surface and further sufficient to produce displacement of the load carrying unit relative to the haul rope at the rope coupling assembly while the load carrying unit is engaged with the docking surface.

BEST MODE OF CARRYING OUT THE INVENTION

The conveying apparatus and method of the present invention is particularly well suited for passenger conveying applications. It will be understood, however, that it can also be used in connection with the transportation of loads other than human passengers. Similarly, the present transportation conveying apparatus and method is particularly well suited for applications in urban environments, such as the transportation of passengers between an airport and the parking structure, but it can also be used at ski resorts or other non-urban facilities to transport people from one location to the other. The present haul rope-driven conveying system is essentially a horizontal elevator in which rope tensioning and docking problems have been alleviated by the manner in which the cabin, car, vehicle or carrier unit is coupled to the haul rope.

Figure 1:
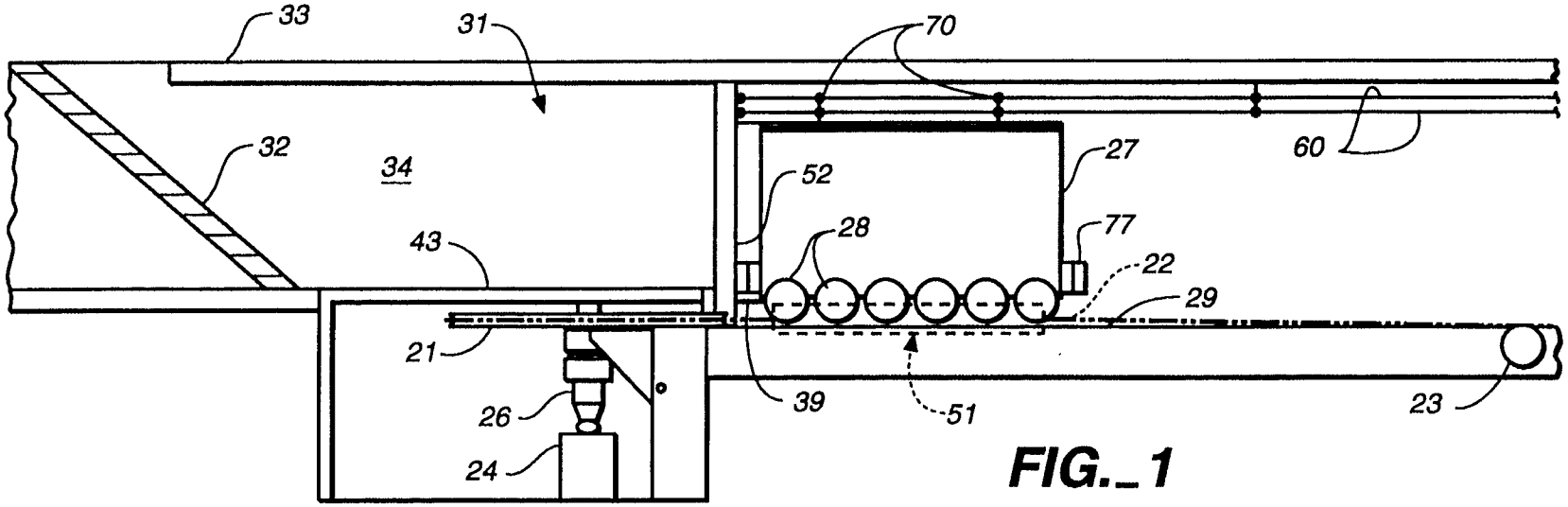
FIG. 1 is a fragmentary, side elevation schematic view of a passenger carrying conveying system constructed in accordance with the present invention.
Figure 2:
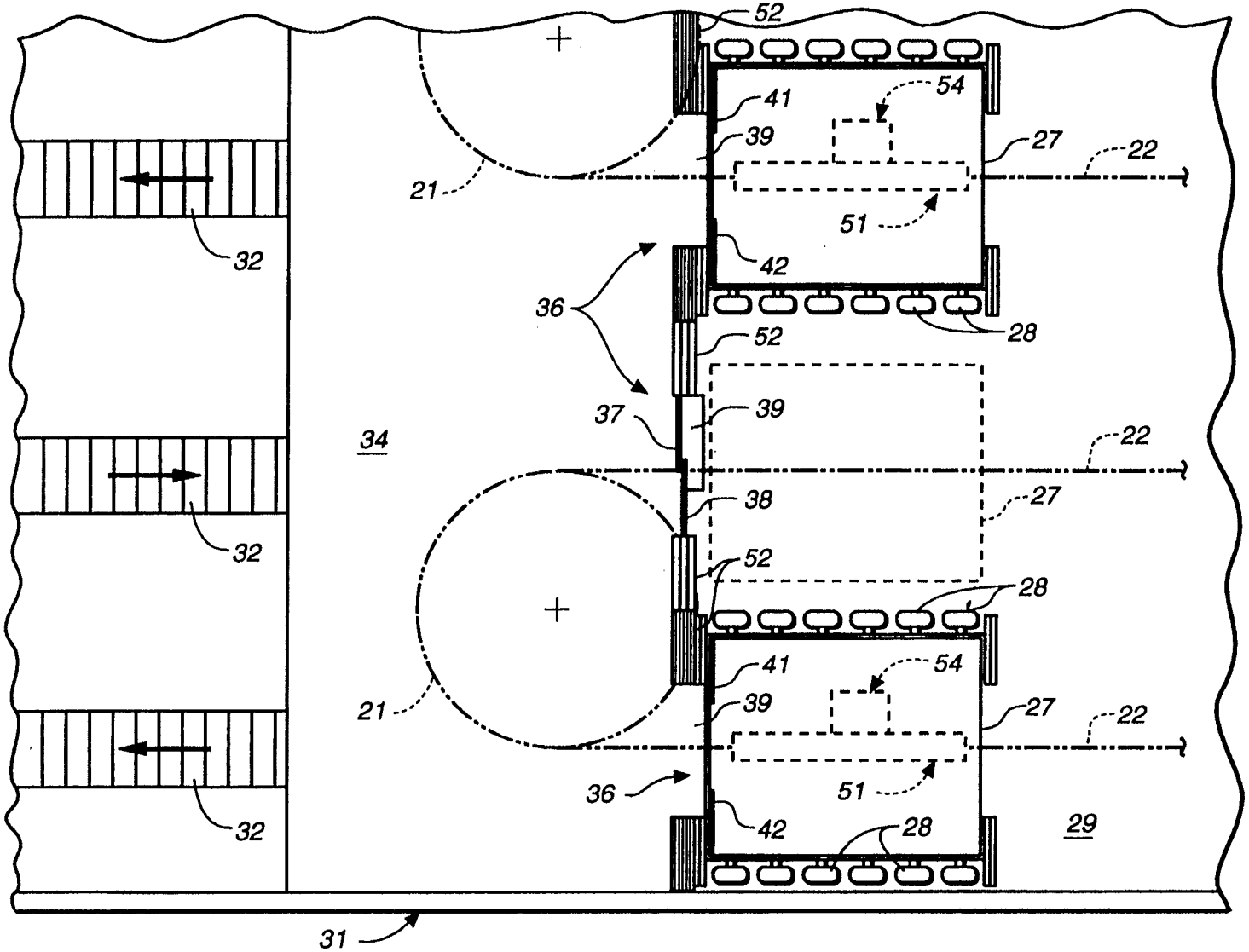
FIG. 2 is a fragmentary, top plan view corresponding to FIG. 1.

Referring now to FIGS. 1 and 2, an installation of the conveying or transport system of the present invention is shown which would be typical of an airport parking lot-to-terminal application. Mounted on a horizontal drive or bull wheel 21 is a haul rope 22. Various support sheaves 23 can be provided along the path of the conveying system for support of haul rope 21, and bull wheel 21 is driven by motor and controller 24 and drive assembly 26 in a manner well known in the aerial tramway art. Most typically, a second horizontal bull wheel (not shown) will be placed at the opposite end of the path, and the haul rope will return to bull wheel 21, as best may be seen in FIG. 2.

Coupled to haul rope 22 to be driven thereby is a car, cabin, vehicle or carrier unit 27 which can include a plurality of wheels 28 which engage a support surface 29 over which the load carrying unit is advanced by the haul rope. A first terminal, generally designated 31, typically will be provided proximate one end of the looped haul rope, and a second terminal (not shown in FIGS. 1 and 2) will be provided at the opposite end of rope 22 and will be formed substantially as shown and described in connection with first end terminal 31, except that the bull wheel will normally be an idler wheel, not a driven wheel.

In various conventional conveyor systems one of bull wheel 21 and the opposite bull wheel will be mounted on a carriage which can be moved, pneumatically, hydraulically or through the use of a counterweight, away from the other bull wheel. This movement tensions haul rope 22. Alternatively, counterweights are sometimes used intermediate the end of bull wheels to effect tensioning, but that is not practical for systems having a vehicle or car on both sides of the haul rope loop.

Systems which employ a drive bull wheel at one end of the loop and a carriage which has a counterweight or an active tensioning force applied during driving of the carriage will produce tension forces in the haul rope which are not symmetrical or the same when the direction of driving is reversed. Moreover, carriage-mounted bull wheels inherently have more components than stationary bull wheels.

In the conveying system of the present invention, both bull wheels on which the loop is mounted are stationary, and all haul rope tension is generated at carrier unit 27, which greatly simplifies construction and maintenance of the transportation system.

Returning to FIGS. 1 and 2, an escalator or stairway 32 can lead from the ground surface level 33 to a waiting room area 34 in terminal 31. A doorway, generally designated 36, having retractable doors 37 and 38 provides an entrance to the load carrying unit 27 which also has retractable doors 41 and 42. The doorway structure 36 can include an outwardly extending apron portion 39 that is on the same floor level 43 as the rest of the waiting room and is at the same floor level as the floor in carrier unit 27. Although not shown, passenger carrier unit 27 will also include a second set of retractable doors at the opposite end of the cabin to allow ingress and egress to the unit through the opposite end when passenger carrier unit 27 is shuttled to the second terminal. The structure of the doorway assemblies in the terminals, and the doors on the passenger carrier units is well known in the art, as are the automatic controls for opening the doors upon docking of the passenger carrier unit with the terminal.

As best may be seen in FIG. 2, each end terminal 31 can include a waiting area 34 in which there are a plurality of doorways 36 against which load carrying units 27 will dock. The users can enter the passenger carrier units as they dock and the respective waiting room doors automatically open. The system is shown in an underground installation, but it will be understood that it also can be installed above ground, and can even be elevated.

It will be appreciated that it will be essential for load carrying units 27 to dock very closely to apron 39 so that passengers can walk on and off the load carrying unit without any danger. Federal codes now require that the gap be no greater than one inch if the transportation system is to be used by disabled users. Thus, load carrying unit 27 at one end of haul rope 22 must dock precisely with first terminal 31 as a similar load carrier 27 docks precisely with the end terminal at the opposite end of the haul rope. Since the haul rope distance can be anywhere from a few hundred to fifteen hundred feet, or possibly longer, stopping the bull wheel 21 precisely is a substantial problem.

The conveying or transportation system of the present invention solves the rope tensioning and unit docking problem by providing a rope coupling assembly, generally designated 51, which is formed to create and maintain the tension in haul rope 22 necessary to shuttle the passenger carrier units between the end terminals, while also being formed for yieldable displacement of haul rope 22 with respect to carrier unit 27 upon engagement of carrier unit 27 with a docking surface to solve docking precision problems.

Figure 3:
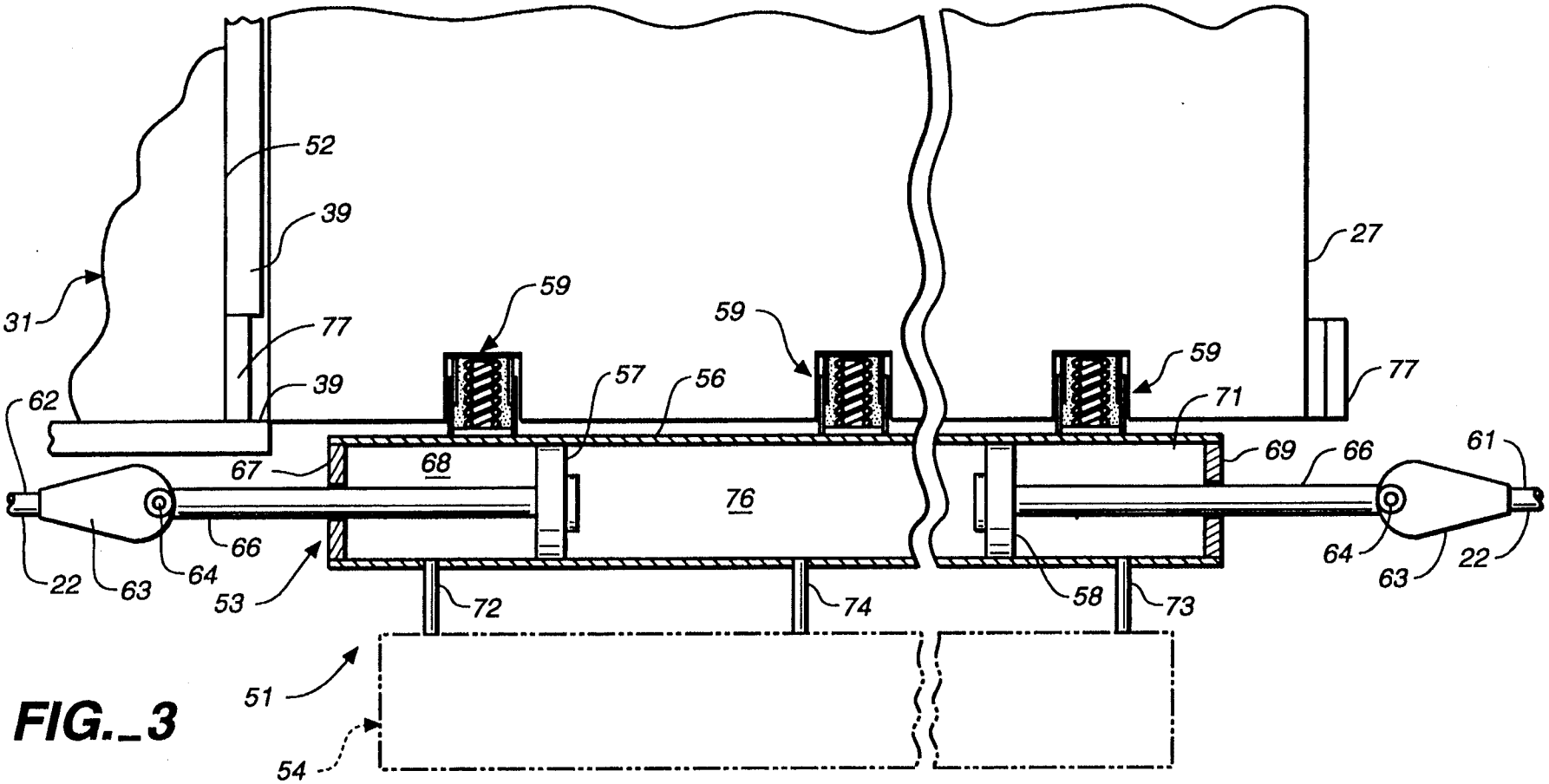
FIG. 3 is an enlarged, fragmentary, side elevation view corresponding to FIG. 1 showing a rope coupling assembly constructed in accordance with the present invention.

The preferred form of haul rope coupling assembly 51 employed in the conveying system of the present invention can best be seen in FIG. 3. Coupling assembly 51 preferably is provided by a piston-cylinder assembly 53 to which a fluid circuit 54 is connected. The fluid circuit will be described in greater detail in connection with FIG. 4. Most preferably, piston-cylinder assembly 53 includes a common elongated cylinder 56 in which at least one, and preferably two, pistons 57 and 58 are mounted. A movable one of the piston-cylinder assembly 53, in this case first piston 57 and second piston 58, is coupled to haul rope 22, while a stationary one of the assembly, in this case cylinder 56, is coupled or mounted to load carrying unit 27. In the preferred form, cylinder 56 can include a plurality of mounting assemblies 59, which can accommodate limited relative vertical displacement between load or passenger carrier unit 27 and cylinder 56, while advancing the vehicle in response to advancement of haul rope. As shown, spring and sleeve assemblies couple cylinder 56 to unit 27.

Opposite ends 61 and 62 of haul rope 22 can be swaged or otherwise secured in a mounting collar 63, which in turn is pinned at 64 to piston rod 66. The first piston 57 extends through a first end wall 67 in cylinder 56 and defines between end wall 67 and piston head 57 a first working volume 68 therebetween. Similarly, second piston 58 extends through end wall 69 and defines a second working volume 71 with the piston head. As will be seen, fluid circuit 54 is fluid coupled by a conduit 72 to first working volume 68 and is fluid coupled by conduit 73 to second working volume 71. A third fluid conduit 74 is fluid coupled to an intermediate volume 76 between the first and second pistons.

In order to allow relative yieldable displacement of rope 22 with respect to carrier 27, fluid circuit 54 is formed to permit the working fluid in first volume 68 and in second volume 71 to flow between the respective volumes. Thus, when a bumper assembly 77 carried by passenger carrier unit 27 engages docking surface 52 at terminal 31, haul rope 22 continues to be driven for a short distance by bull wheel 21. This pulls first piston 57 to the left in FIG. 3 toward cylinder end wall 67 and reduces first working volume 68. So as not to create dramatically increasing tension force in haul rope 22, fluid circuit 54 allows the working fluid displaced out of working volume 68 to flow into working volume 71 between second piston 58 and end wall 69 of the cylinder. This causes second piston 58 to move to the left by an amount substantially equal to the movement of first cylinder 57. Thus, the haul rope essentially continues to advance when bumper 77 hits docking surface 52 and the two pistons move to the left until the bull wheel stops. This over-travel of the bull wheel ensures that passenger carrier unit 27 will be urged up against and will firmly abut the docking surface and therefore be held in registration with terminal apron 39 which extends out to passenger carrier unit 27.

Once the passenger carrier unit is loaded, it is shuttled down toward the second terminal, and docking at the second terminal essentially reverses the process. The bumper 77 engages a docking surface at the second terminal, but the bull wheel drives haul rope 22 for a short distance after engagement has occurred, which causes pistons 58 and 57 to move to the right relative to stationary cylinder 56. Again, precise docking is ensured by over-travel of the haul rope.

A typical drive profile for driving bull wheel 21, therefore, is to accelerate the carrier unit 27 away from an end terminal at a rate of acceleration which is comfortable to the passengers until the top speed of the conveying system is reached. This speed is maintained until a deceleration point at which the drive wheel 21 is slowed to decelerate the load carrying unit down to a crawl speed over a distance which again is comfortable to the passengers. The carrier unit is then driven at the crawl speed until bumper 57 encounters a docking surface, at which point haul rope advancement continues to ensure that docking has occurred. The passenger carrier unit does not advance, but the piston-cylinder assembly 51 enables yieldable advancement of the haul rope with respect to the passenger carrier unit to ensure docking.

Figure 4:
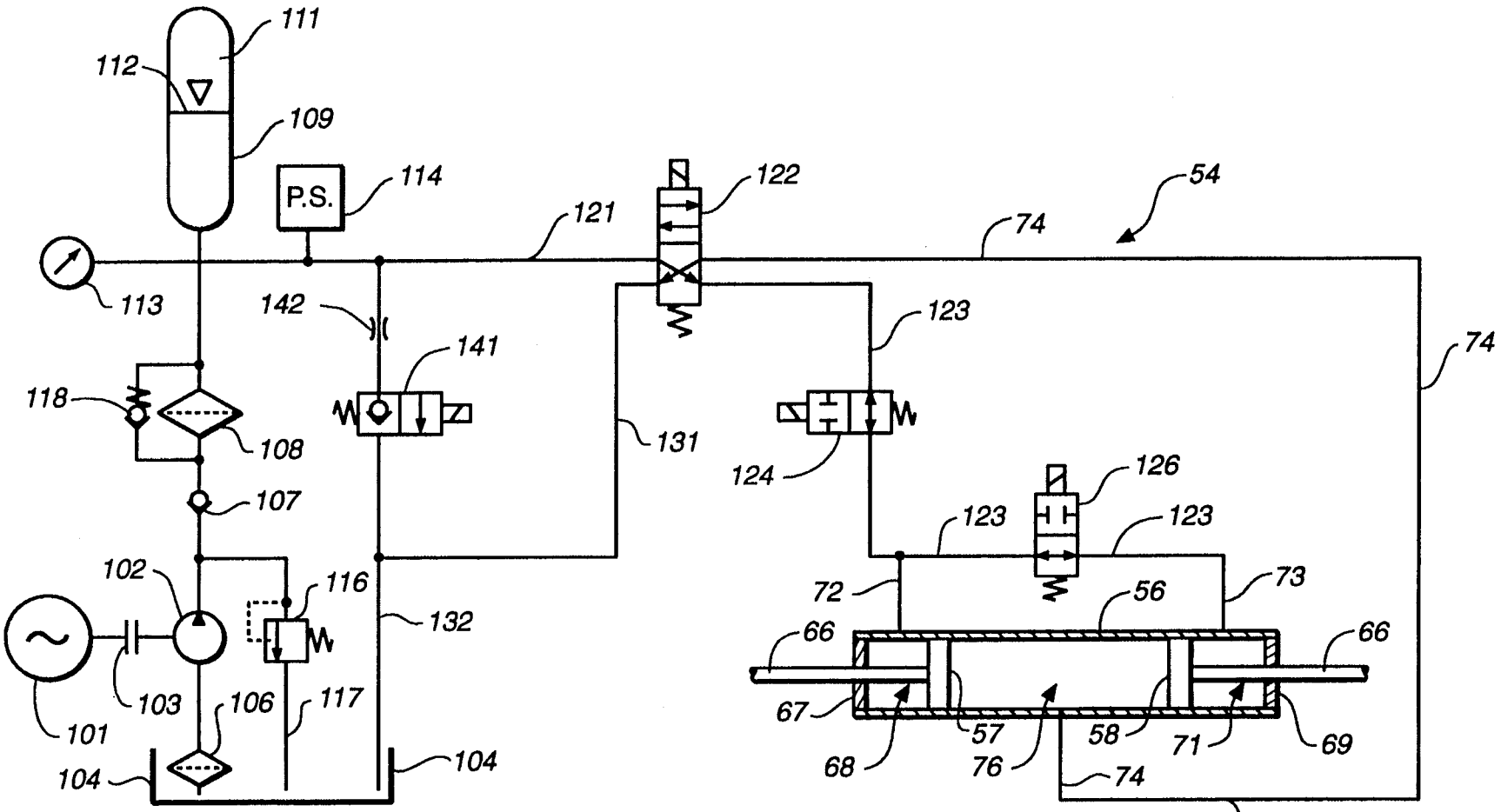
FIG. 4 is a schematic representation of a fluid circuit suitable for use with the rope coupling assembly of FIG. 3.

The details of construction of one fluid circuit suitable for use with the piston-cylinder, rope coupling assembly of FIG. 3 is shown in FIG. 4. Fluid circuit 54 is shown as a hydraulic circuit in which the working fluid is an oil, but it will be understood that a pneumatic circuit also could be employed, and that there are mechanical equivalents to rope coupling assembly 51.

In circuit 54 motor 101 drives pump 102 through coupling 103. The oil or working fluid is drawn from tank 104 through screen or strainer 106 and driven through check valve 107 and through filter 108 to a gas accumulator 109. The gas under pressure in volume 111 acts on the working fluid accumulated at 112. Pressure gauge 113 can be provided, as can pressure switch 114 which is coupled to deactivate motor 101 once a pressure threshold in the accumulator has been reached. A biased relief valve 116 guards against overpressure and returns through line 117 to tank. Similarly, a biased check valve 118 can be provided around filter 108. Mounted in output line 121 is a four-way, two position solenoid valve 22. In the position shown in FIG. 4, fluid will flow from line 122 to conduit 123 and from there through a normally open solenoid valve 124 to input conduit 72 to first working volume 68. Line 123 continues through two position, normally open, solenoid valve 126 which is coupled to input conduit 73 to working volume 71 of cylinder 56.

Thus, in the position shown in FIG. 4, pump 102 can pump working fluid into volumes 68 and 71 and displace first piston 57 and second piston 58 toward each other, which thereby applies a tension force to haul rope 22. As pistons 57 and 58 move toward each other, fluid in intermediate volume 76 is exhausted out conduit 74, which returns the fluid to the two-position, four-way solenoid valve 122. As shown in FIG. 4, the returning fluid then passes to conduit 131 and from there to conduit 132, which returns to tank 104. Thus, the pressure does not rise in space 76 to resist tensioning of the haul rope.

The tensioning of the haul rope at the load carrying unit 27 eliminates the need to provide bull wheel tensioning carriages and/or counterweight tensioning devices. All bull wheels in the system may be stationary and the rope tension created by rope coupling assembly 51. When two, or more, carrier units 27 are mounted to the rope one or more of them can be used to create rope tension. In shuttle systems, it is preferable that two units 27 be coupled to the haul rope and that each have a tensioning coupling 51 which creates one-half of the tension force.

It also will be understood that the carrier unit mounted rope tensioning assembly of the present invention can be applied to non-shuttle applications.

A further important feature of fluid circuit 54 is that once the haul rope is tensioned, solenoid valve 124 can be moved to a normally open position to thereby isolate cylinder 56 from the portion of fluid circuit 54 upstream of valve 124. This fixes the tension force in haul rope 22 and eliminates the need to constantly operate pump 102 or depend upon accumulator 109. Moreover, it is important to be certain that tension forces are the same when shuttle systems reverse drive directions that the tension forces are the same, i.e., symmetrical. The present system, and particularly valve 124, allows tension to be adjusted when no torque is applied by drive bull wheel 21 and for tension to be fixed by opening valve 124 when torque is applied by bull wheel 21 to the haul rope. The tension force in haul rope 22, therefore, will be the same regardless of the direction of driving.

When passenger carrier unit 27 contacts the docking surface at either end of the passenger carrier unit, the fluid in working volume 68 and in working volume 71 communicate with each other through conduits 72, 123 and 73, as well as open solenoid valve 126. The fluid is simply allowed to move between working volume 68 and working volume 71, as needed to allow pistons 57 and 58 to float inside cylinder 56, either to the left or to the right, depending upon which terminal is engaged. This floating action while rope tension is maintained by opening valve 124, allows very precise docking of the carrier units by slightly over-driving the haul rope.

Relaxation of the tension in haul rope 22, for example, to periodically replace the haul rope, can be accomplished by moving switch 122 to the second position and opening valve 124. This will allow fluid to be pumped into intermediate volume 76 in cylinder 56 and the fluid in volumes 68 and 71 to be returned to tank.

The fluid circuit can also include normally closed solenoid dump valve 141 and orifice 142 so that accumulator liquid can be returned to the tank in a controlled manner if desired.

Another substantial advantage of rope coupling assembly 51 of the present invention is that it facilitates haul rope replacement and repair. A very difficult and time-consuming task in conventional shuttle tramway assemblies having looped or endless haul ropes is the problem of replacing the haul rope. In the present invention, the coupling which allows tensioning at the load carrying unit and over-driving to ensure precise docking also allows easier replacement of the haul rope. One of the two lengths of haul rope 22 between the respective passenger carrier units 27 can be replaced and the system retensioned, which significantly reduces system down-time.

Figure 5:
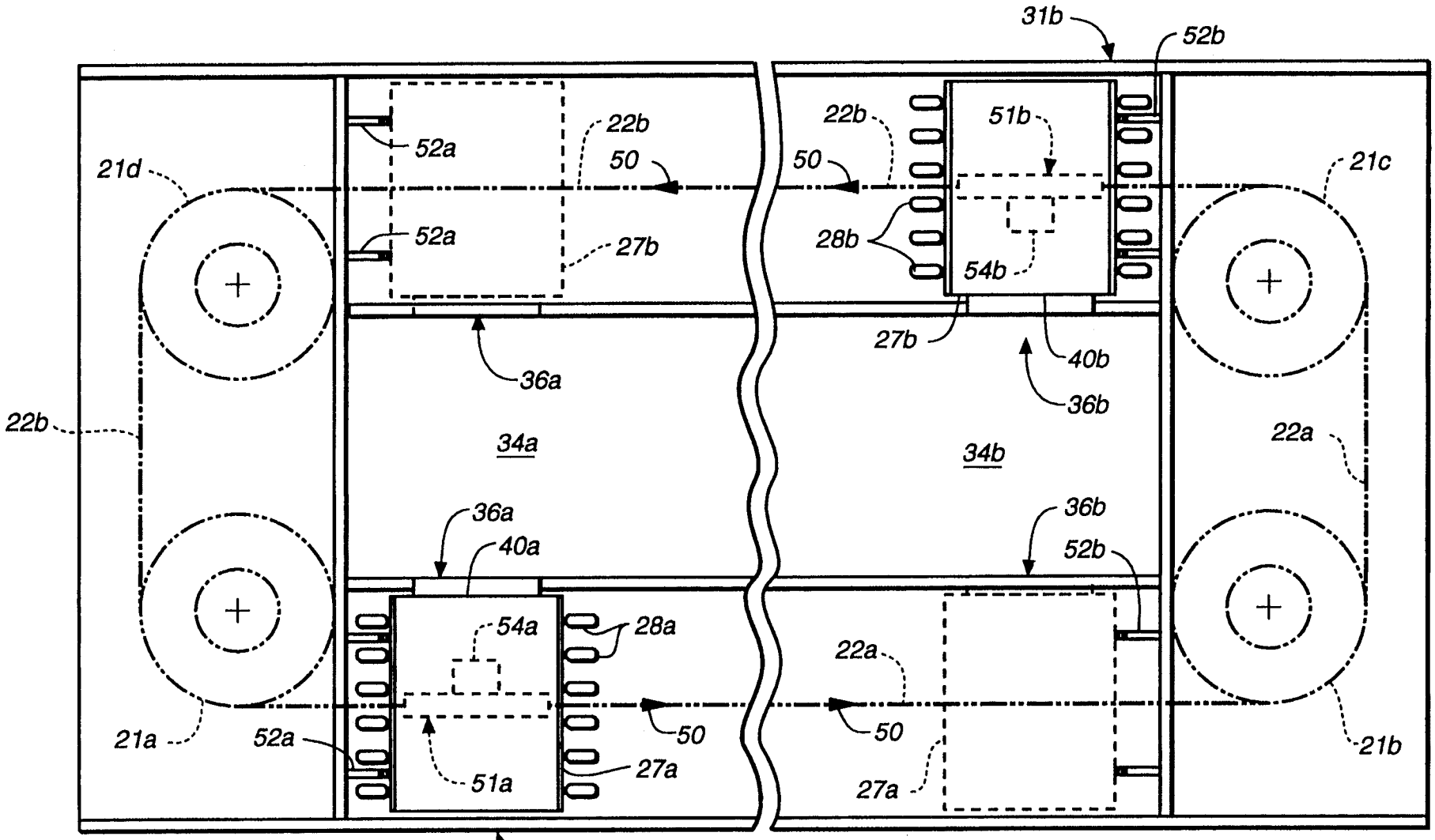
FIG. 5 is a top plan view of an alternative embodiment of a shuttle-type passenger conveying system constructed in accordance with the present invention.

FIG. 5 shows an alternative embodiment of the conveying or transporting system of the present invention in which both end terminals are shown. Thus, a first passenger carrier unit **27*a* is shown docked at first end terminal 31*a*, while second passenger carrier unit 27*b* is docked at second terminal 31*b*. First terminal 31*a* has a passenger waiting area 34*a* and second terminal 31*b* has a passenger waiting area 34*b*. As will be understood, terminals 31*a* and 32*b* can be separated by any desired distance. In the form of the transportation system of FIG. 5, the passenger carrier units 27*a*, 27*b* each have retractable doors in their sides 40*a* and 40*b* which communicate with waiting room door assemblies 36*a* and 36*b* when the passenger carrier units are properly docked. The units also include support wheels 28*a* and 28*b* for rolling support of the units as they are driven by haul rope 22*a* and 22*b*, which together forms a loop around four horizontal bull wheels 21*a*–21*d*. The rope tensioning assembly 51*a*, 51*b* allows all of the bull wheels 21*a*, 21*b*, 21*c* and 21*d*** to be mounted with fixed axes of rotation.

The rope coupling assemblies **51*a* and 51*b* and associated fluid circuits 54*a* and 54*b* also facilitate docking. The door assemblies on the passenger carrier unit are brought into registration with the waiting room door assemblies 36*a*, 36*b* by engagement of a side wall of the passenger carrier units with docking members or surfaces 52*a* and 52*b***.

One or more of bull wheels **21*a*–21*d* can be driven, and the controls for driving the same are programmed to over-drive the cable by an amount sufficient to cause cables 22*a*, 22*b* to advance relative to the passenger carrier units. This ensures that each of the passenger carrier units will be snugged up against or in docking engagement with the docking surfaces 52*a*, 52*b*** at the respective terminals.

The transportation system of FIG. 5, therefore, allows passengers to move from waiting rooms **34*a*, 34*b* into the respective passenger carrier units and then be conveyed in the direction of arrows 50 to the other terminal. The doors will then automatically open and the passengers can leave the passenger carrier units and another group of passengers board from the opposite side of the waiting areas. This process is repeated as the passenger carrier units shuttle between terminals 31*a* and 31*b***.

It should also be noted in connection with FIG. 1 that power can be provided to passenger carrier unit 27 by overhead electrical transmission lines 60 to which the electrical system, including motor 101 and the various controls for solenoid valves in fluid circuit 54, are connected through slidable couplings 70. Other techniques for providing power on carrier unit 27 and for operating motor 101 can be employed within the scope of the present invention.

Figure 6:
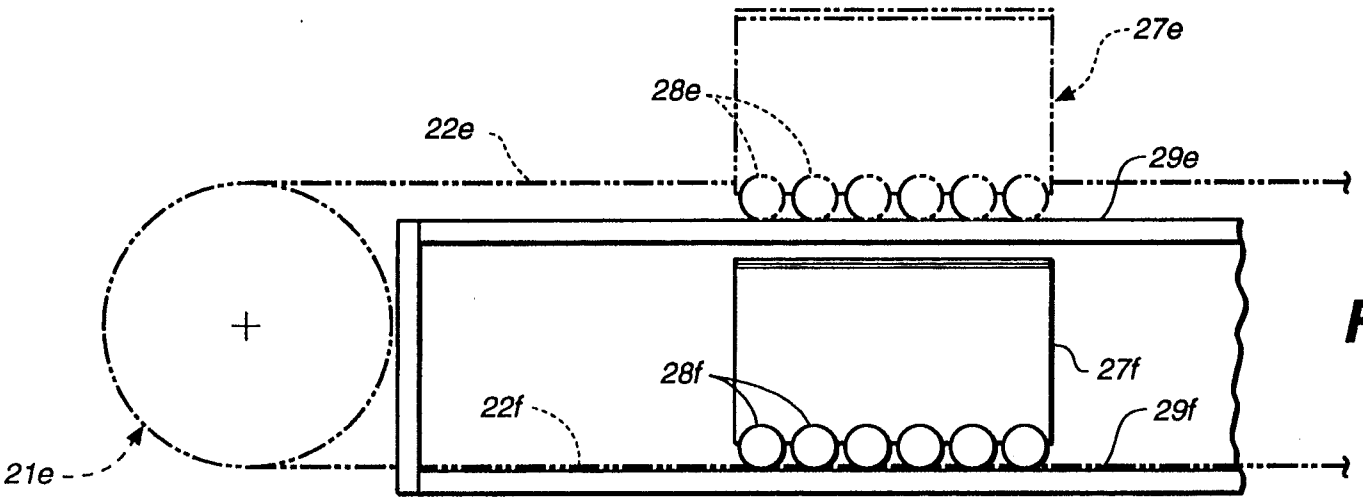
FIG. 6 is a fragmentary, side elevation view of still a further alternative embodiment of the conveying system of the present invention.

In FIG. 6 still a further alternative embodiment of the transportation system of the present invention is shown in which bull wheel **21*e* is vertically oriented and supports an upper stretch 22*e* of haul rope and a lower stretch 22*f*. Coupled to upper stretch 22*e* is an upper carrier unit 27*e* which is supported on upper support surface 29*e* by a plurality of wheels 28*e*. A similar lower carrier unit 27*f* is supported on wheels 28*f* from support surface 29*f*. The upper load carrying unit 27*e* is shown in broken lines because when lower unit 27*f* is proximate vertical bull wheel 21*e*, the unit 27*e*** will be correspondingly proximate and opposite vertical bull wheel (not shown).

The two passenger carrier units, therefore, can be shuttled back and forth between terminals (not shown) along the haul rope path. The passenger carrier units can have end or side opening doors which mate with corresponding waiting areas at the respective terminals. Again, each of carrier units **27*e* and 27*f* is coupled to the respective haul ropes 22*e* and 22*f*** by a rope coupling assembly that will enable rope tensioning and will yield to allow over-driving of the haul rope to ensure proper docking.

It should be noted that it is possible in the apparatus and method of the present invention to have terminals intermediate the ends of the looped hauls ropes. In such structures, the docking surface against which the passenger carrier unit would engage preferably would be selectably extendible (transversely across the haul rope path) and retractable to permit continued advancement past the intermediate terminal docking surface to the end terminals.

It will also be apparent that the conveying system of the present invention could be used to shuttle a single passenger carrier unit back and forth between terminals. It is regarded as being preferable to have a second passenger carrier unit on the return line in order to increase the transportation system's capacity. Similarly, the docking and over-drive features of the system of the present invention can be employed at one terminal only, particularly if docking at the second terminal is not critical. Moreover, the haul rope does not have to be mounted in a continuous or endless loop.

As will be understood from the description of the apparatus of the transportation system of the present invention, the present method of tensioning a haul rope-based conveying system is comprised of the steps of providing a tensioning apparatus on a load carrying unit 27, and tensioning the haul rope using such apparatus. The docking method of the present invention includes the steps of advancing a haul rope 22 coupled to a load carrier unit 27 by a rope coupling assembly 51 until the load carrier unit is proximate docking surface 52 at a terminal 31. Thereafter, the present method includes a step of continuing to advance the haul rope over a distance sufficient to ensure both engagement of the load carrying unit 27 with docking surface 22 and displacement of the load carrying unit relative to the haul rope while the load carrying unit is engaged with the docking surface. At the same time, the steps are accomplished while maintaining tension in the haul rope.

In the preferred form of the present invention, common haul rope coupling cylinder 56 will have a length about equal to the length of passenger carrier unit 27, for example, 8 to 16 feet in length. A typical installation would include a haul rope between about 1000 to 1500 feet in length over a path one-half that length. Tensioning of the haul rope from a slack to fully tensioned position will require approximately 6 feet of movement of pistons 57 and 58. In a shuttle system having two passenger carrier units 27, however, each unit need only take up 3 feet of the extension in order to fully tension haul rope 22. This means that each piston is displaced by only about 1 to 1½ feet. If the length of the piston rods and the cable are selected properly, pistons 57 and 58 can be positioned at about 1 foot from the respective end walls of cylinder 56. Tensioning will move them 1½feet toward each other, leaving a central volume 76 which is approximately 3 to 7 feet in length, depending upon the length of the cylinder. This would allow pistons 57 and 58 to float by up to 2½ feet before encountering the respective end walls.

In the typical installation, the drive 24 for bull wheel 21 would be programmed to over-drive the haul rope by only a few inches in each direction, for example, 6 inches or less. One can adjust the position of pistons 57 and 58 inside cylinder 56 by pushing against one of the docks and advancing the haul rope by motor 24 by small increments until the two pistons are roughly centered. Preferential migration of the pistons toward one end or the other of the cylinder 56 cannot occur because of the shuttle operation, but the rope coupling assembly can be adjusted at any time to the center by advancing the units to the appropriate dock and continuing the advancement so as to shift both pistons back toward the center of the cylinder.

What is claimed is:

1. A load carrying conveying system comprising:

an elongated traction member mounted for movement along a path, a terminal positioned along said path and having a docking surface extending transversely to said path, and a carrier unit coupled to said traction member to be conveyed along said path to said terminal by a coupling assembly formed to maintain tension in said traction member during conveying of said carrier unit along said path, said coupling assembly being comprised of a piston-cylinder assembly with a fluid circuit connected to pressurize said piston-cylinder assembly, and said traction member being coupled to a movable one of a piston and a cylinder and said carrier unit being coupled to the other of said piston and said cylinder, and said coupling assembly being formed for yieldable displacement of said traction member relative to said carrier unit upon engagement of said carrier unit with said docking surface at said terminal.

2. The conveying system as defined in claim 1 wherein, said traction member is a haul rope extending over said path, and said piston is normally positioned intermediate opposed ends of said cylinder during conveying of said carrier unit by said haul rope, said cylinder is pressurized by said fluid circuit on at least one side of said piston, and said fluid circuit is formed for flow of fluid from said one side of said piston to effect yieldable displacement of said carrier unit relative to said haul rope.

3. The conveying system as defined in claim 2 wherein, said haul rope is a loop-type haul rope coupled at one end to a first piston movably mounted in said cylinder and coupled at an opposite end to a second piston movably mounted in said cylinder, said cylinder being coupled to said carrier unit, and said fluid circuit is connected to pressurize said cylinder between each of the pistons and opposite ends of said cylinder.

4. The conveying system as defined in claim 3 wherein, said fluid circuit further includes pressure relief means venting said cylinder at a position intermediate said first piston and said second piston.

5. The conveying system as defined in claim 4 wherein, said fluid circuit includes pressure generation means formed to displace said pistons toward each other in said cylinder to effect tensioning of said haul rope.

6. The conveying system as defined in claim 1 wherein, said fluid circuit is a hydraulic circuit.

7. The conveying system as defined in claim 1 wherein, said traction member is a haul rope, said carrier unit is shuttled back and forth along said path, said terminal is provided proximate an end of said path, and a second terminal provided proximate an opposite end of said path with a second docking surface extending transversely of said path for engagement by said carrier unit upon docking of said carrier unit at said second terminal, and said coupling assembly being formed for displacement of said carrier unit relative to said haul rope upon engagement of said second docking surface in a direction opposite to the direction of relative displacement when said carrier unit engages the first-named docking surface.

8. The conveying system as defined in claim 7 wherein, said piston-cylinder assembly includes two pistons each movably mounted in a cylinder and each in spaced relation to and extending through an end wall of said cylinder to define a working volume within said cylinder, said haul rope being coupled at one end to one of said pistons and being coupled at an opposite end to another of said pistons, and said fluid circuit being formed to release fluid from one working volume of said piston-cylinder assembly and admit a substantially equal amount of fluid into the other working volume of said piston-cylinder assembly to permit movement of said carrier unit relative to said haul rope while maintaining tension forces in said haul rope.

9. The conveying unit as defined in claim 8 wherein, said two pistons are mounted in a common cylinder to define a working volume at each end of said cylinder, and relief means venting said cylinder intermediate said pistons and the working volumes.

10. A shuttle personnel conveying system comprising:

a loop-type haul rope mounted to a plurality of sheaves for movement along a path;

a first terminal positioned proximate one end of said path and having a first docking surface extending transversely of said path;

a second terminal positioned proximate an opposite end of said path and having a second docking surface extending transversely of said path;

a passenger carrier unit coupled to said haul rope for advancement between said first terminal and said second terminal;

a drive assembly coupled to said haul rope and formed for advancement of said haul rope in one direction until said passenger carrier unit engages said first docking surface and for advancement of said haul rope in an opposite direction until said passenger carrier unit engages said second docking surface, said drive assembly being formed to advance said haul rope beyond the position at which said passenger carrier unit engages said first docking surface and beyond the position at which said passenger carrier unit engages said second docking surface; and a fluid piston-cylinder rope coupling assembly having at least one of a movable piston and a movable cylinder with one of said piston and said cylinder being coupled to said haul rope and the other of said piston and said cylinder being coupled to said passenger carrier unit, said fluid piston cylinder rope coupling assembly being formed for advancement of said haul rope relative to said passenger carrier unit while said passenger carrier unit is engaged with said first docking surface and with said second docking surface.

11. The shuttle conveying system as defined in claim 10 wherein, said piston-cylinder assembly is provided by a common cylinder, a first piston extending out through an end wall of one end of said common cylinder and connected to said haul rope, a second piston extending out through an end wall of an opposite end of said common cylinder, and a fluid circuit coupled to said common cylinder for flow of substantially equal volumes of a working fluid into and out of the opposite ends of said common cylinder to permit advancement of said haul rope when said passenger carrier unit is engaged with one of the docking surfaces.

12. The shuttle assembly as defined in claim 10 wherein, said fluid piston-cylinder rope coupling assembly is a hydraulic assembly having a working liquid confined for movement between two volumes to permit movement of said carrier unit relative to said haul rope.

13. The shuttle assembly as defined in claim 12 wherein, said hydraulic assembly includes a common cylinder coupled to said passenger carrier unit and two pistons mounted in said common cylinder and coupled to opposite ends of said haul rope.

14. A method of precisely docking a load carrier unit at a terminal comprising the steps of:

coupling said load carrier unit to a haul rope by a rope coupling assembly provided by a piston-cylinder assembly by coupling a movable one of a piston and a cylinder to said haul rope and coupling a stationary one of said piston and said cylinder to said load carrier unit;

advancing said haul rope coupled to said load carrier unit by said rope coupling assembly until said load carrier unit is proximate a docking surface at said terminal; and thereafter continuing to advance said haul rope over a distance sufficient to ensure both engagement of said load carrying unit until said movable one of said piston and said cylinder is displaced relative to said stationary one of said piston and said cylinder with said docking surface and displacement of said haul rope relative to said load carrying unit while said load carrying unit is engaged with said docking surface and while maintaining said haul rope under tension.

15. The method as defined in claim 14 wherein, during said advancing step and said step of continuing to advance, supporting said load carrier unit by wheel means on a support surface.

16. The method as defined in claim 15 wherein, during said coupling step a stationary common cylinder is coupled to said load carrier unit, a movable first piston is coupled to one end of said haul rope and a movable second piston is coupled to an opposite end of said haul rope.

17. The method as defined in claim 16 wherein, during said coupling step, said common cylinder has a fluid circuit communicating therewith, and is coupled to said load carrier unit, said fluid circuit connecting portions of said common cylinder and being formed to enable tensioning of said haul rope and flow of a working fluid between portions of said common cylinder for substantially equal displacement of said first piston and said second piston while maintaining tensioning of said haul rope.

18. A transportation system comprising:

a haul rope mounted for advancement on a plurality of support sheaves;

a load carrier unit mounted to said haul rope for advancement thereby; and a haul rope tensioning assembly carried by said load carrier unit and formed to create and maintain tension forces in said haul rope sufficient to advance said load carrier unit, said rope tensioning assembly being a piston-cylinder assembly coupled to a fluid circuit connected to pressurize a cylinder and displace a piston to effect tensioning of said haul rope.

19. The apparatus as defined in claim 18 wherein, said fluid circuit is formed to isolate said piston-cylinder assembly to maintain tension forces in said haul rope after creating thereof by said fluid circuit.

20. The apparatus as defined in claim 18 wherein, said piston is movable and connected to said haul rope, and said fluid circuit is formed to permit displacement of said piston in said cylinder without reducing tension forces in said haul rope.

21. The apparatus as defined in claim 18 wherein, said piston-cylinder assembly is provided by a common cylinder, a first piston extending out through an end wall of one end of said common cylinder and connected to said haul rope, a second piston extending out through an end wall of an opposite end of said common cylinder, and said fluid circuit is coupled to said common cylinder for flow of substantially equal volumes of a working fluid into and out of the opposite ends of said common cylinder.

* * * * *